US008398500B1

(12) United States Patent
Bouvier

(10) Patent No.: US 8,398,500 B1
(45) Date of Patent: Mar. 19, 2013

(54) GOLF GAME SYSTEM

(76) Inventor: Marc Bouvier, Long Beach, CA (US)

( * ) Notice: Subject to any disclaimer, the term of this patent is extended or adjusted under 35 U.S.C. 154(b) by 244 days.

(21) Appl. No.: 12/965,576

(22) Filed: Dec. 10, 2010

Related U.S. Application Data

(60) Provisional application No. 61/285,912, filed on Dec. 11, 2009.

(51) Int. Cl.
*A63B 69/36* (2006.01)

(52) U.S. Cl. ..... 473/192; 473/153; 273/371

(58) Field of Classification Search ..... 473/150–15, 473/190–196; 273/371–377
See application file for complete search history.

(56) References Cited

U.S. PATENT DOCUMENTS

| | | | | |
|---|---|---|---|---|
| 4,006,907 | A * | 2/1977 | Heffley, Jr. | 473/192 |
| 4,846,478 | A * | 7/1989 | Saint-Cricq | 473/153 |
| 5,184,824 | A * | 2/1993 | Riedinger | 473/156 |
| 5,445,374 | A * | 8/1995 | Clark, Jr. | 473/191 |
| 5,513,841 | A * | 5/1996 | Takagi | 473/134 |
| 5,884,913 | A * | 3/1999 | Cohen | 473/154 |
| 5,938,537 | A * | 8/1999 | Liu | 473/192 |
| 5,980,392 | A * | 11/1999 | Cox | 473/192 |
| 6,322,455 | B1 * | 11/2001 | Howey | 473/168 |
| 6,717,684 | B1 * | 4/2004 | Fikes et al. | 356/614 |
| 2003/0004005 | A1 * | 1/2003 | Ainsworth et al. | 473/151 |
| 2003/0195052 | A1 * | 10/2003 | Cohen et al. | 473/151 |
| 2004/0204258 | A1 * | 10/2004 | Hanoun | 473/154 |
| 2006/0084529 | A1 * | 4/2006 | Burkons | 473/409 |
| 2007/0078018 | A1 * | 4/2007 | Kellogg et al. | 473/151 |
| 2011/0031696 | A1 * | 2/2011 | Su et al. | 273/371 |

FOREIGN PATENT DOCUMENTS

| | | | |
|---|---|---|---|
| WO | WO 9701376 | A1 * | 1/1997 |
| WO | WO 2008068499 | A1 * | 6/2008 |

* cited by examiner

*Primary Examiner* — Mark Graham

(57) ABSTRACT

The present invention features a golf game system 100 comprising a mat 210 for placing on a ground surface; a post 110 disposed at a first position on the mat, wherein the post 110 functioning as a target, wherein disposed on a first end of the pole 110 is a scoreboard system 220; and a first camera 310 extending from the first end of the pole 110 in a first direction, and a second camera 320 extending from the first end of the pole 110 in a second direction, wherein the cameras function to localize the ball and calculate its position.

1 Claim, 7 Drawing Sheets

System layout diagram

System Logic Diagram

Object image processing from video camera (a-g)

(a)original image, (b)pre-process, (c)image separation, (d)boundary detection, (e)2nd medium value filtering, (f)refinement, (g)characterization imaging

GOLF GAME SYSTEM

This application is a non-provisional patent application, which claims priority to provisional patent application Ser. No. 61/285,912 filed Dec. 11, 2009, the disclosure of which is incorporated in its entirety herein by reference.

BACKGROUND OF THE INVENTION

The present invention is directed to a golf game, more particularly to a system that can detect a position where a golf ball lands in a designated area and assign points to a user based on the position. For example, a flag is used as a target, and a user tries to hit his/her ball closest to the flag. Points may be assigned based on how close the user hits his/her ball to the flag. In some embodiments, the system comprises a scoreboard for keeping score. The system of the present invention may help a user improve his/her golf game, and can also provide entertainment.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
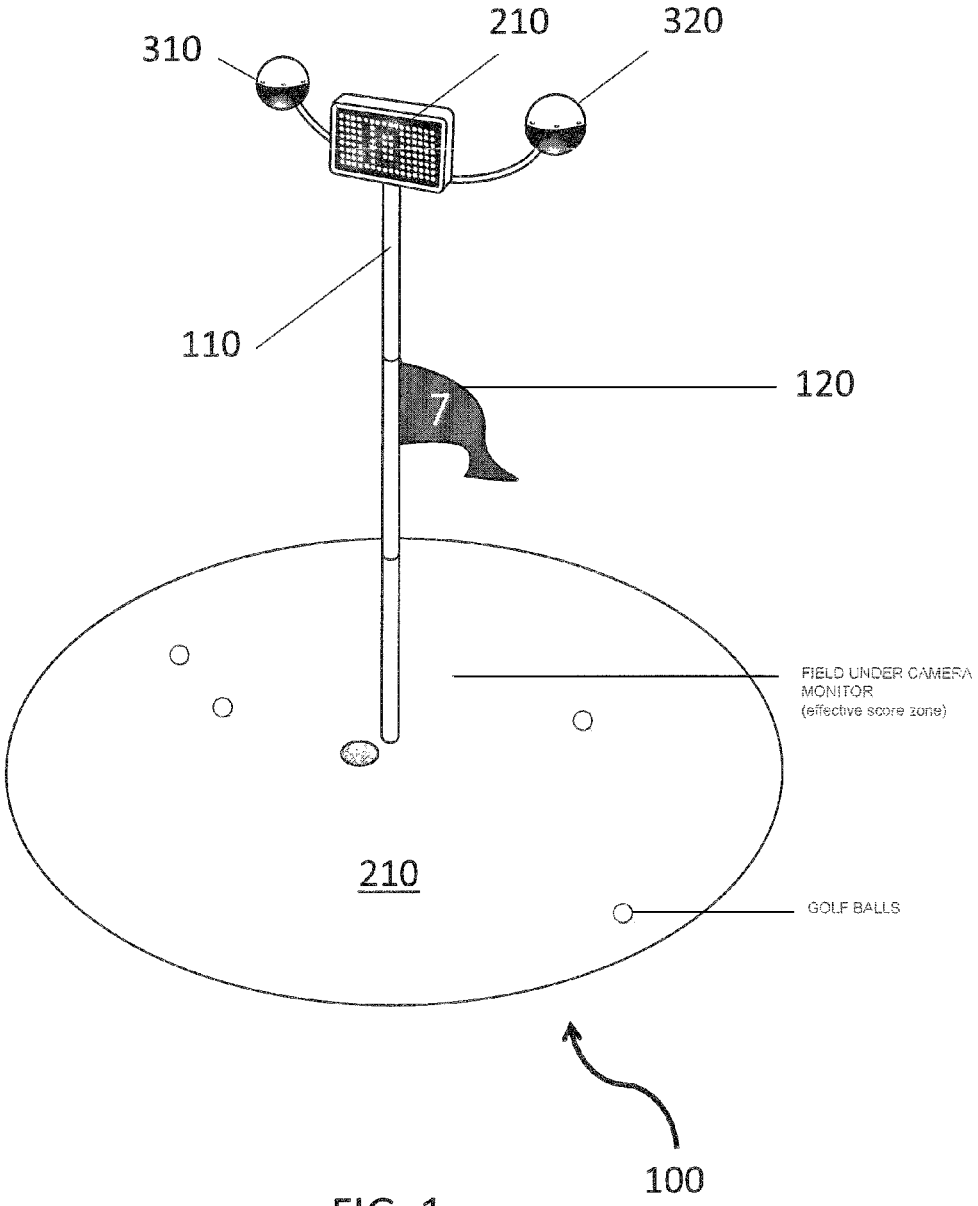
FIG. 1 is a first perspective view of the golf game system of the present invention.
Figure 2:
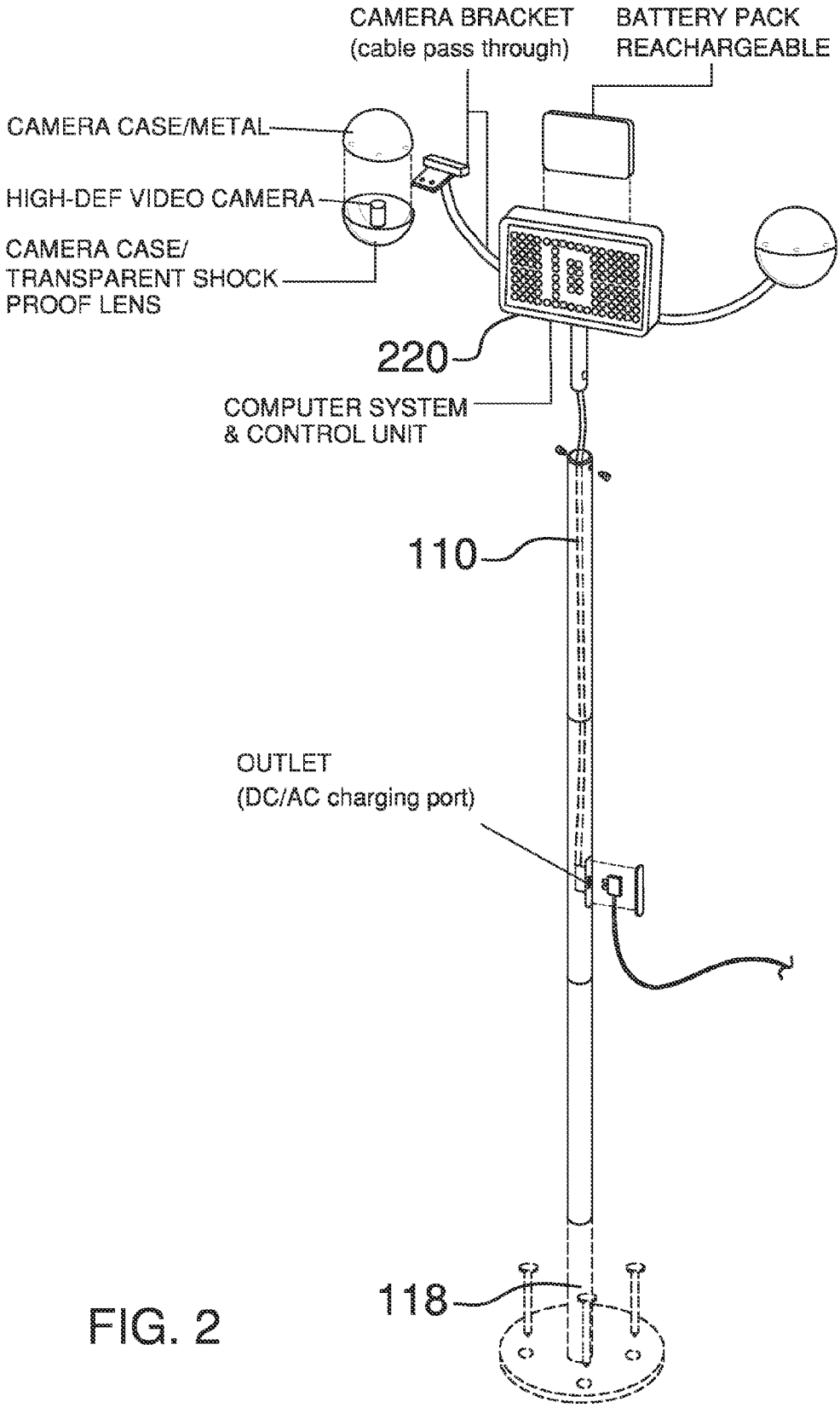
FIG. 2 is a second perspective view of the golf game system of the present invention.
Figure 3:
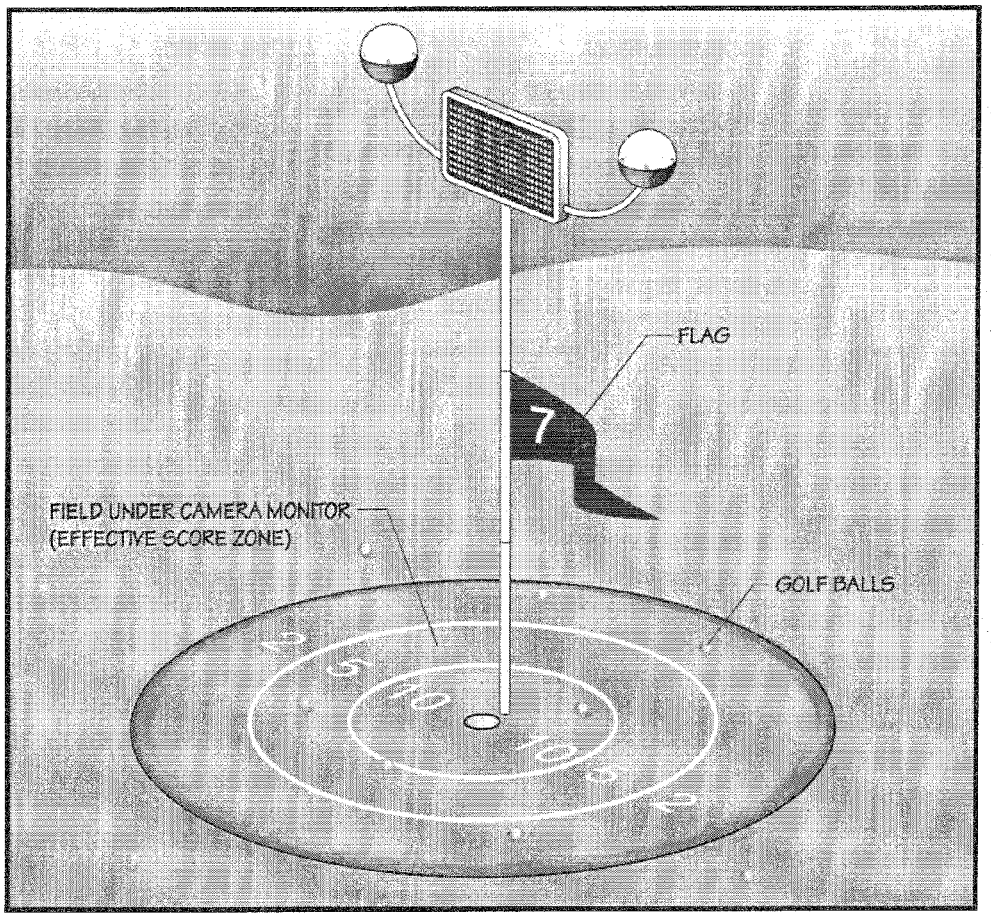
FIG. 3 is a third perspective view of the golf game system of the present invention.

Referring now to FIGS. 1-7, the present invention features a golf game system 100. The system 100 can detect where a golf ball lands in a designated area and assign points to a user based on the position. The system 100 of the present invention may help a user improve his/her golf game, and can also provide entertainment.

The golf game system 100 may be used on a golf course, a driving range, or the like. In some embodiments, a plurality of golf game systems 110 is placed in various areas on the golf course or the driving range.

In some embodiments, the system 100 comprises a mat 210 for placing on a ground surface. A post 110 (or flag) is disposed at a first position on the mat (e.g., in the middle of the mat 210), the post 110 functioning as a target. Users (e.g., players) aim for the post 110 when hitting the golf ball. The post 110 may be constructed in a variety of sizes. For example, in some embodiments, the post 110 is between about 4 to 6 feet in height (as measured from the first end to the second end). In some embodiments, the post 110 is between about 6 to 8 feet in height. In some embodiments, the post 110 is between about 8 to 10 feet in height. In some embodiments, the post 110 is more than about 10 feet in height. The post 110 (e.g., the first end of the post 110) fits into a standard golf hole, which is well known to one of ordinary skill in the art.

A flag may be disposed on the post 110, for example extending outwardly from the post 110. The flag may be positioned near the second end (e.g., top end) of the post 110. The pole 110 may be constructed in a various interconnecting pieces (e.g., 3 pieces). In some embodiments, the pole 110 is a telescopic pole.

The mat 210 may be constructed in a variety of sizes. In some embodiments, the mat 210 is between about 5 to 10 feet in diameter. In some embodiments, the mat 210 is between about 10 to 15 feet in diameter. In some embodiments, the mat 210 is between about 15 to 20 feet in diameter. In some embodiments, the mat 210 is between about 20 to 25 feet in diameter. In some embodiments, the mat 210 is more than about 25 feet in diameter. The pole 110 may be anchored, for example in the mat 210, via a securing means 118 (see FIG. 2).

Disposed on the first end (e.g., top end) of the pole 110 is a scoreboard system 220. The scoreboard system may be similar to standard scoreboards, which are well known to one of ordinary skill in the art. For example, such scoreboards are commonly used in arcade games. In some embodiments, the scoreboard is a liquid crystal display (LCD).

Extending from the first end of the pole 110, for example in a first direction is a first camera 310. Extending from the first end of the pole 110, for example in a second direction, is a second camera 320. The cameras may be constructed from a variety of materials, for example from a material comprising a metal, a plastic, the like, or a combination thereof. The cameras 310, 320 are durable and shock proof. The cameras 310, 320 may be high-speed and/or high-definition cameras.

In some embodiments, the cameras function to localize the ball (e.g., detect where the ball has landed), for example the cameras are configured to detect the presence of the ball and calculate its position. Camera recognition technology is well known to one of ordinary skill in the art. For example, face recognition technology is often used in digital cameras. Software can be adapted to recognize the golf ball (or a component of the golf ball, for example if a special component is added to the golf ball to provide a specific means for the cameras detecting the golf ball). In some embodiments, special golf balls may be constructed from a material with thermal properties, and the cameras can detect (e.g., via infrared detection) the presence of the golf balls by detecting the material with thermal properties. The present invention is not limited to infrared detection or face recognition technology.

The cameras are operatively connected to a microprocessor. The microprocessor is configured to receive signals from the cameras, for example signals regarding the presence of the golf ball and/or the location of the golf ball. The microprocessor is configured to assign a point value based on where the golf ball lands. The microprocessor can send output signals to the scoreboard to display the point value (from the golf ball) or a total score.

The present invention is not limited to use of cameras for detection of golf balls. In some embodiments, sensors (e.g., motion sensors, etc.) are disposed on the mat 210, and the sensors 210 may be activated when the ball lands on or near them. The sensors may be operatively connected to the microprocessor. The microprocessor receives the signals from the sensors and calculates a point value based on the sensor it received a signal from. Or, in some embodiments, a transmitter is disposed in the ball, the transmitter being configured to transmit a signal (a short distance) to various receivers disposed in the mat 210. The transmitter sends a signal only over a short distance so that only the receivers that are extremely close to the ball will detect the ball. The receivers may be operatively connected to the microprocessor, whereby the microprocessor can detect the position of the ball based on the signals received from the receivers.

Generally, the closer the ball is hit to the post 110 the more points that are scored. The mat 210 may be divided into sections (e.g., a first section, a second section, a third section, etc.) In some embodiments, a first set of sensors is disposed in the first section (closest to the post 110), a second set of sensors is disposed in the second section (the second section being in the middle of the mat 210), and a third set of sensors is disposed in the third section (the third section being the outermost section of the mat 210). In some embodiments, the first section is a 0 to 2 foot radius around the post 110, the second section is between a 2 to 5 foot radius around the post, and the third section is between a 5 to 10 foot radius around the post 110. The present invention is not limited to these measurements for the sections, nor is the present invention limited to three sections. For example, in some embodiments, the first section is a 0 to 5 foot radius around the post 110, the second section is between a 5 to 10 foot radius around the post, and the third section is between a 10 to 20 foot radius around the post 110.

In some embodiments, the microprocessor is disposed in the scoreboard system 220.

In some embodiments, the microprocessor and/or sensors and/or cameras and/or display (e.g., LCD) are operatively connected to a power source, for example via wiring. Wiring may be housed in the post 110. In some embodiments, the post has an AD/DC charging port. In some embodiments, the power source is a battery. In some embodiments, the battery is a rechargeable battery. The battery (e.g., rechargeable battery) may be stored behind the scoreboard 220.

In some embodiments, the system 100 allows for scores to be kept (e.g., points can be tallied). Scorekeeping programs and components thereof are well known to one of ordinary skill in the art.

In some embodiments, the system 100 comprises a light system, which may be activated when the ball lands on the mat 210 (or in a certain section of the mat 210). The lights may flash, the lights may be of various colors. Any combinations of lighting may be used.

Points can be assigned to the sections where the ball lands. Points may include but are not limited to 2 points, 5 points, 10 points, etc.

Image processing programs in combination with the cameras may allow for auto tracking and position detecting (of the golf ball). The system may track and detect the position of the ball in the defined area, for example around the mat 210. As an example, the cameras and software may function to detect or calculate an X position and a Y position of the golf ball within a defined coordinate system, and assign points based on the X and Y position.

Figure 4:
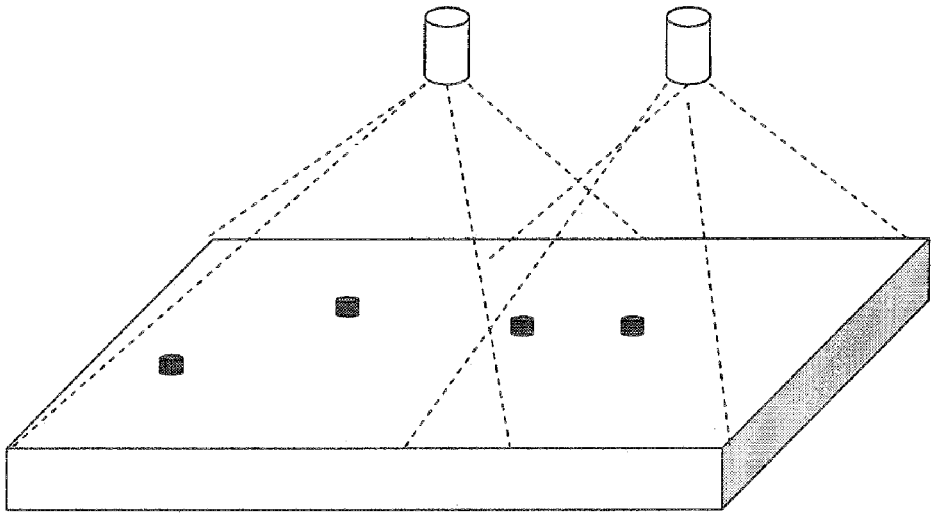
FIG. 4 is a diagram illustrating an example of a layout of the system of the present invention.

In some embodiments, the system 100 has image resolution (e.g., 10 mm) and/or the ability to detect velocity of the object (golf ball) (e.g., 0 mm/sec to 5 mm/sec). In some embodiments, the mat 210 (monitoring zone) is about 3 m in diameter, or about 3 m by 3 m in area. The mat 210 (monitoring zone) is not limited to this dimension. In some embodiments, the camera allows for detection up to about 3.0 meters. As shown in FIG. 4, two cameras monitor the mat 210 and are configured to auto track and/or monitor and/or detect positioning of the golf ball.

Figure 5:
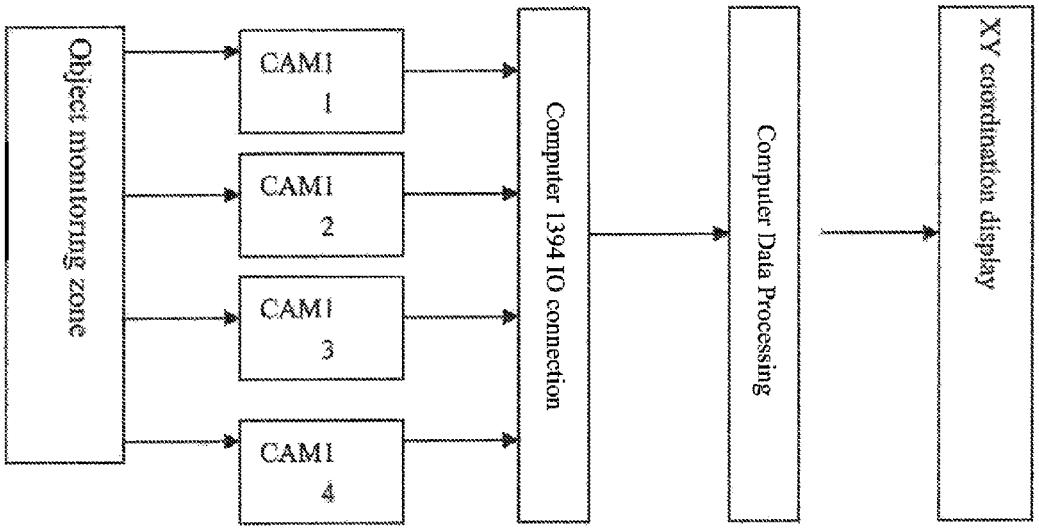
FIG. 5 is a system logic diagram.
Figure 6:
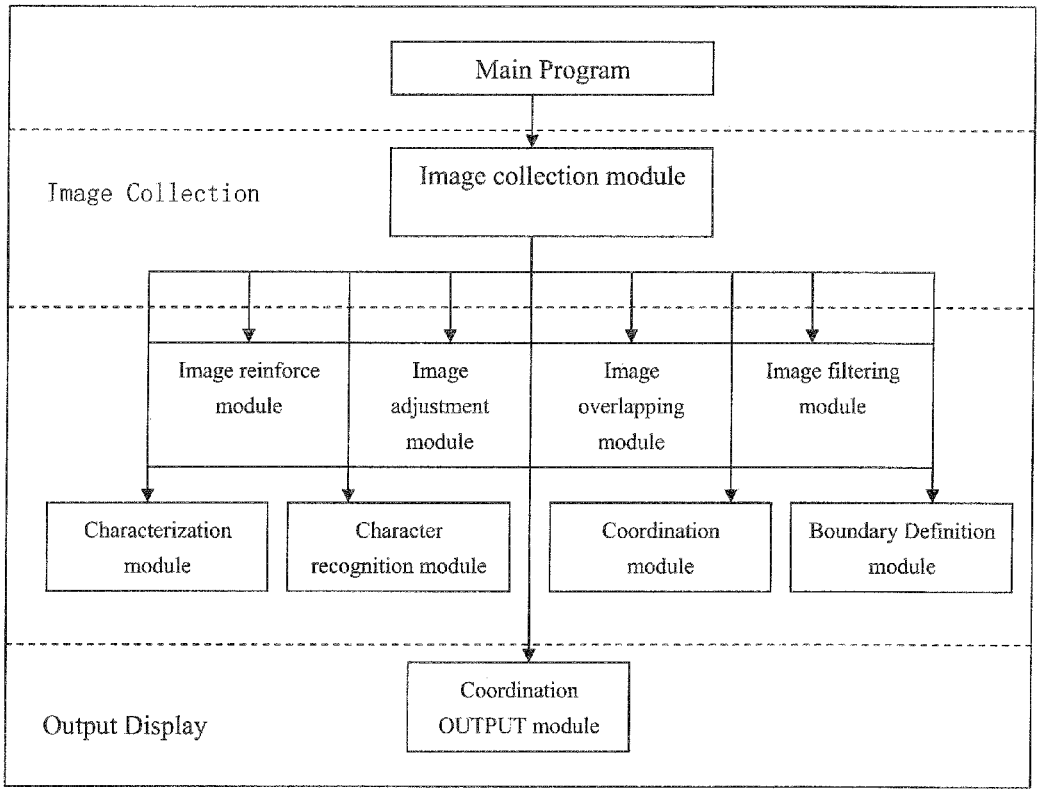
FIG. 6 is a diagram showing examples of microprocessor processing.
Figure 7:
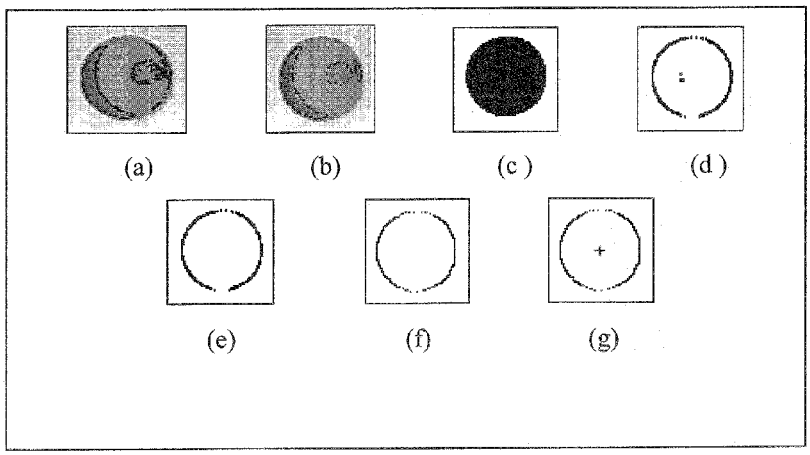
FIG. 7 is a diagram showing object image processing from a video camera.

The cameras can relay images, for example whole area images, to the microprocessor for processing. The microprocessor can calculate ball positioning (e.g., via image processing software, etc.) and send output signals to the display 220 accordingly. FIG. 5 shows an example of microprocessor processing. This logic diagram comprises four cameras.

In some embodiments, the system 100 utilizes various processing algorithms, can monitor various sized objects, and can monitor various sized area, etc. In some embodiments, the cameras are color video cameras. Resolutions may include but are not limited to 1600×1200, bus bar I/O protocol may include 1394, microprocessor speed may include 3G, processing time may include 0.2 s. The present invention is not limited to the aforementioned examples.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

What is claimed is:

1. A golf game system 100 comprising:

(a) a mat 210 for placing on a ground surface;

(b) post 110 disposed at a first position on the mat, wherein the post 110 functioning as a target, wherein disposed on a first end of the pole 110 is a scoreboard system 220;

(c) a first camera 310 extending from the first end of the pole 110 in a first direction, and a second camera 320 extending from the first end of the pole 110 in a second direction, wherein the cameras function to localize a ball and calculate its position.

* * * * *